US009985352B2

(12) United States Patent
Mead Gill et al.

(10) Patent No.: US 9,985,352 B2
(45) Date of Patent: May 29, 2018

(54) DYNAMICALLY ALLOCATED BROADBAND MULTI-TAP ANTENNA

(71) Applicant: The Boeing Company, Chicago, IL (US)

(72) Inventors: Margaret A. Mead Gill, Seattle, WA (US); Matthew G. Rivett, Seattle, WA (US)

(73) Assignee: The Boeing Company, Chicago, IL (US)

( * ) Notice: Subject to any disclaimer, the term of this patent is extended or adjusted under 35 U.S.C. 154(b) by 97 days.

(21) Appl. No.: 15/135,002

(22) Filed: Apr. 21, 2016

(65) Prior Publication Data

US 2017/0310010 A1 Oct. 26, 2017

(51) Int. Cl.
*H01Q 1/50* (2006.01)
*H01Q 5/50* (2015.01)
*H01P 5/16* (2006.01)

(52) U.S. Cl.
CPC ..... *H01Q 5/50* (2015.01); *H01P 5/16* (2013.01); *H01Q 1/50* (2013.01)

(58) Field of Classification Search
CPC ..... H01Q 5/50; H01Q 1/50
USPC ..... 343/876
See application file for complete search history.

(56) References Cited

U.S. PATENT DOCUMENTS 5,861,844 A 1/1999 Gilmore et al.
6,640,110 B1 * 10/2003 Shapira ..... H01Q 1/246 342/373
6,809,694 B2 * 10/2004 Webb ..... H01Q 3/32 343/754
6,930,647 B2 * 8/2005 Wako ..... H01Q 13/06 343/772
6,963,314 B2 * 11/2005 Webb ..... H01Q 3/32 342/374
8,063,832 B1 11/2011 Weller et al.
8,378,921 B2 2/2013 Delfeld et al.
8,521,172 B2 * 8/2013 Rosenau ..... H04W 28/16 455/424

(Continued)

FOREIGN PATENT DOCUMENTS

EP 1046962 10/2000

OTHER PUBLICATIONS

Extended European Search Report dated Sep. 6, 2017 for EP Patent Application No. 17155543.6.

*Primary Examiner* — Huedung Mancuso
(74) *Attorney, Agent, or Firm* — Gates & Cooper LLP

(57) ABSTRACT

A dynamically allocated broadband multi-tap antenna comprises a plurality of sub-wavelength conductors used for transmitting and/or receiving radio frequency (RF) signals; a plurality of antenna taps, each of which is connected to one or more of the conductors; a plurality of RF switches, each of which is connected to one of the antenna taps; and a plurality of combiners (which also function as splitters), each of which is connected to one or more of the RF switches. The RF switches are controlled to dynamically allocate and interconnect the antenna taps with a selected combiner, to communicate the RF signals between the conductors connected to the antenna taps and the selected combiner. The RF signals received by the conductors are combined into an output signal at the selected combiner, while an input signal at the selected combiner is split for transmission as the RF signals by the conductors.

21 Claims, 2 Drawing Sheets

(56) References Cited

U.S. PATENT DOCUMENTS

| | | | | |
|---|---|---|---|---|
| 8,706,165 | B2 * | 4/2014 | Skarby | H01Q 1/246 343/751 |
| RE45,775 | E * | 10/2015 | Agee | H04W 52/265 |
| 2012/0068882 | A1 | 3/2012 | Blachford | |
| 2013/0120216 | A1 | 5/2013 | Delfeld et al. | |

* cited by examiner

DYNAMICALLY ALLOCATED BROADBAND MULTI-TAP ANTENNA

CROSS REFERENCE TO RELATED APPLICATION

This application is related to the following commonly-assigned application:

U.S. Utility patent application Ser. No. 12/200,259, filed on Aug. 28, 2008, by Thomas Peter Delfeld and Matthew Gregory Rivett, entitled "BROADBAND MULTI-TAP ANTENNA," now U.S. Pat. No. 8,378,921, issued Feb. 19, 2013;

which application is incorporated by reference herein.

BACKGROUND INFORMATION

1. Field

The invention is related generally to the field of antennas, and more particularly, to a dynamically allocated broadband multi-tap antenna.

2. Background

Antennas are used in many different systems and applications, such as communications, global positioning, radar, transponders, and other systems and applications. For example, antennas may be used on aircraft or other vehicles to provide for these and other functions. In many cases, physical space on vehicles is limited. Therefore, it is desirable to have an antenna that is as small as possible.

Antenna size is defined here in terms of wavelengths. A small antenna is defined as one that is a fraction of a wavelength in size. One way to make an antenna small is to sacrifice bandwidth.

Small antennas are typically either narrow band or inefficient. For example, small broadband antennas have significant dissipative loss, which reduces gain. This dissipative loss allows the small antenna to operate in a broadband manner, but reduces its efficiency. Nonetheless, with a broadband antenna, a single antenna may be used in place of multiple antennas that operate at different frequencies.

Thus, there is a need for small antenna structures that operate in a broadband manner, but reduce loss, in order to maximize efficiency. The present invention satisfies this need.

SUMMARY

To overcome the limitations in the prior art described above, and to overcome other limitations that will become apparent upon reading and understanding the present specification, a dynamically allocated broadband multi-tap antenna is disclosed, as well as a method of using the antenna and a method of making the antenna.

The dynamically allocated broadband multi-tap antenna comprises a plurality of conductors, wherein the conductors are sub-wavelength conductors used for transmitting and/or receiving radio frequency (RF) signals; a plurality of antenna taps, wherein each of the antenna taps is connected to one or more of the conductors; a plurality of RF switches, wherein each of the RF switches is connected to one of the antenna taps; and a plurality of combiners (which also act as splitters), wherein each of the combiners is connected to one or more of the RF switches.

One or more of the RF switches are controlled to dynamically allocate one or more of the antenna taps to a selected one of the combiners, by interconnecting the one or more of the antenna taps with the selected one of the combiners via the RF switches, to communicate the RF signals between the conductors connected to the one or more of the antenna taps and the selected one of the combiners. Thus, the RF signals received by the conductors connected to the one or more of the antenna taps are combined into an output signal at a port of the selected one of the combiners, while an input signal from a port of the selected one of the combiners is split for transmission as the RF signals by the conductors connected to the one or more of the antenna taps.

The features, functions, and advantages that have been discussed can be achieved independently in various embodiments or may be combined in yet other embodiments, further details of which can be seen with reference to the following description and drawings.

DRAWINGS

Referring now to the drawings in which like reference numbers represent corresponding parts throughout:

DETAILED DESCRIPTION

In the following description of the preferred embodiment, reference is made to the accompanying drawings which form a part hereof, and in which is shown by way of illustration specific embodiments in which the present invention may be practiced. It is to be understood that other embodiments may be utilized and structural changes may be made without departing from the scope of the present invention.

Overview

A dynamically allocated broadband multi-tap antenna of relatively small size is comprised of a plurality of sub-wavelength conductors used for transmitting and/or receiving RF signals; a plurality of antenna taps, each of which is connected to one or more of the conductors; a plurality of RF switches, each of which is connected to one of the antenna taps; and a plurality of combiners (which are also splitters), each of which is connected to one or more of the RF switches. The RF switches are controlled to dynamically allocate the antenna taps to a selected combiner, by interconnecting the antenna taps with the selected combiner, to communicate the RF signals between the conductors connected to the antenna taps and the selected combiner. The RF signals received by the conductors connected to the antenna taps are combined into an output signal at a port of the selected combiner, or an input signal at a port of the selected combiner is split for transmission as the RF signals by the conductors connected to the antenna taps.

Consequently, the dynamically allocated broadband multi-tap antenna maximizes both functionality and bandwidth. The sub-wavelength conductors and associated antenna taps enable broadband gain and pattern performance, which is especially useful at lower frequencies where antenna size limits overall bandwidth performance.

Typically, lower frequency functions have their own antenna elements, which are physically separate from other functions and their associated antenna elements. The RF switches allow the dynamically allocated broadband multi-tap antenna to be used by more than one function, thereby reducing or eliminating the need for a separate antenna for each function, while allowing the antenna to be more easily integrated into environments with constraints on space.

Technical Description

Figure 1:
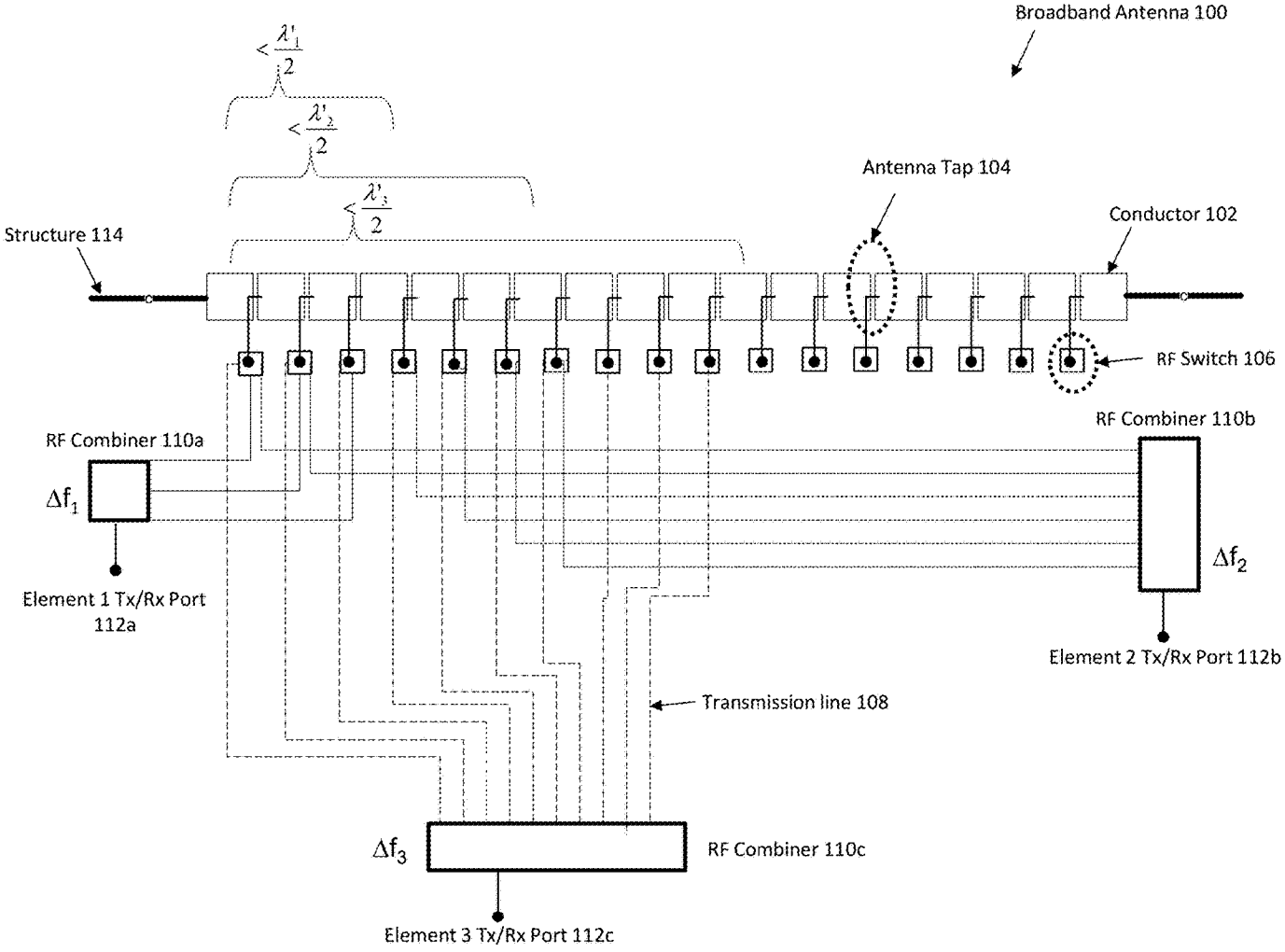
FIG. 1 is a diagram of a dynamically allocated broadband multi-tap antenna according to one embodiment.

FIG. 1 is a diagram of a dynamically allocated broadband multi-tap antenna 100 according to one embodiment. The dynamically allocated broadband multi-tap antenna 100 described herein is a compact or small antenna that meets limited physical space requirements, yet is both broadband and highly efficient.

In this embodiment, the antenna 100 is comprised of a plurality of conductors 102, a plurality of antenna taps 104, a plurality of RF switches 106, a plurality of transmission lines 108, and a plurality of combiners 110 (which also perform as splitters). The conductors 102 are sub-wavelength conductors 102 arranged in a linear array, and are used for transmitting and/or receiving RF signals. Each of the antenna taps 104 is connected to one or more of the conductors 102. Each of the RF switches 106 is connected to one of the antenna taps 104. Each of the combiners 110 is connected to one or more of the RF switches 106 via the transmission lines 108. One or more of the RF switches 106 are controlled, by the combiners 110 or a separate controller (not shown), to dynamically allocate one or more of the antenna taps 104 to a selected one of the combiners 110, by interconnecting the one or more of the antenna taps 104 with the selected one of the combiners 110, to communicate the RF signals between the conductors 102 connected to the one or more of the antenna taps 104 and the selected one of the combiners 110. Specifically, the RF signals received by the conductors 102 connected to the one or more of the antenna taps 104 are combined into an output signal at a port 112 of the selected one of the combiners 110, or an input signal at a port 112 of the selected one of the combiners 110 is split for transmission as the RF signals by the conductors 102 connected to the one or more of the antenna taps 104. These and other aspects are described in more detail below.

In one embodiment, the conductors 102 comprise metal patches, although the conductors 102 may be any type of conductive material, which function as transducers to send and receive RF signals. There are 18 conductors 102 shown in the example of FIG. 1, but any number of conductors 102 may be used.

Typical dimensions the conductors 102 are on the order of 1/10th the wavelength at the lowest frequency of the radio frequency band of operation (1 foot at 100 MHz) with loads (taps 104) spaced about 1/100th of a wavelength apart. In the example of FIG. 1, each of the conductors 102 is about one-half inch long by one inch wide, although any size of conductors 102 may be used.

An antenna tap 104 is a location on a structure of the antenna 100 from which power may be collected, dissipated, or distributed. The conductors 102 are selected to maximize the power delivered at the desired frequency over the widest angles possible to the antenna taps 104.

The antenna taps 104 connect the conductors 102 to each other in a serial arrangement. The antenna taps 104 comprise resistive materials that increase the bandwidth at which the antenna 100 can function. The antenna taps 104 function to provide loss to increase gain in the antenna 100 in these examples.

With multiple taps 104, it is possible to collect or divert power from various locations on the antenna 100 structure into a single load or port. The use of multiple taps 104 has significant advantages for the reduction of antenna 100 size and bandwidth without the constraints imposed by prior methods.

Figure 2:
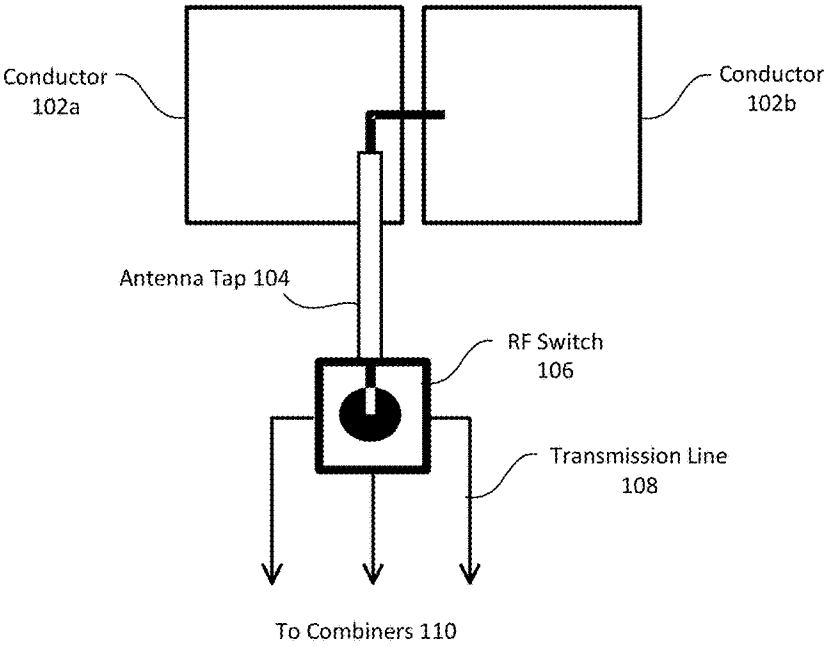
FIG. 2 is a diagram showing an antenna tap connected to two conductors and a radio frequency (RF) switch according to one embodiment.

Each of the antenna taps 104 is connected to two of the conductors 102, as shown in the diagram of FIG. 2. In this example, a subset of two of the conductors 102*a*, 102*b* is depicted, along with an associated antenna tap 104, RF switch 106 and transmission lines 108.

The antenna taps 104 may take various forms. For example, without limitation, the antenna taps 104 may be balanced transmission lines and/or unbalanced transmission lines. In the embodiment of FIG. 2, the antenna tap 104 comprises a coaxial dual conductor having two balanced transmission lines, wherein a first transmission line is electrically connected to the first conductor 102*a*, while a second transmission line is electrically connected to the second conductor 102*b*. In other embodiments, the antenna tap 104 comprises a ribbon cable having two or more unbalanced transmission lines.

Referring again to FIG. 1, the use of RF switches 106 with the antenna taps 104 and conductors 102 broadens the bandwidth of the antenna 100. Assume that $\lambda'_N$ is the minimum wavelength in the RF band $\Delta f_N$. In the example of FIG. 1, as indicated by the annotations above the conductors 102, the following functions are performed:

- the RF switches 106 are controlled to select the first 3 antenna taps 104 and the first 4 conductors 102, which forms an element at a half wavelength $\lambda'_1/2$ or less for the frequency band $\Delta f_1$, in order to combine the signals into an output signal at Element 1 Tx/Rx port 112*a* of the combiner 110*a;*
- the RF switches 106 are controlled to select the first 6 antenna taps 104 and the first 7 conductors 102, which forms an element at a half wavelength $\lambda'_2/2$ or less for the frequency band $\Delta f_2$, in order to combine the signals into an output signal at Element 2 Tx/Rx port 112*b* of the combiner 110*b*; and
- the RF switches 106 are controlled to select the first 10 antenna taps 104 and the first 11 conductors 102, which forms an element at a half wavelength $\lambda'_3/2$ or less for the frequency band $\Delta f_3$, in order to combine the signals into an output signal at Element 3 Tx/Rx port 112*c* of the combiner 110*c*.

Similar functions would be performed when splitting signals from the combiners 110 to the conductors 102.

Moreover, the power received by the antenna taps 104 is recovered by the combiner 110 to decrease the impact of reduced efficiency in the antenna 100. The combiner 110 combines the power received by the antenna taps 104 at the output port 112. In this manner, power received by the antenna taps 104 is captured and used in a manner that provides improved gain for the antenna 100.

Each port 112 of the combiners 110 may be connected to various elements, such that an electrical signal received by the antenna 100 may be processed by the elements, and an electrical signal generated by the elements may be transmitted by the antenna 100. Such elements may be any electrical or electronic device or system for processing RF signals. In one embodiment, the devices or systems provide specific applications onboard an aircraft, such as radio communications systems, satellite communications (SATCOM) systems, global positioning satellite (GPS) navigation systems, transponder systems, radar systems, Traffic alert and Collision Avoidance System (TCAS) systems, electronic warfare systems, instrument landing systems, etc.

Also, in this example, the antenna 100 is shown as being mounted on a structure 114. Such a structure 114 may comprise, for example, an aircraft skin panel, although other structures 114 may be used. With this type of implementation, the antenna 100 may be conformal to a surface of the structure 114. Other components for the multi-tap antenna 100 may be located on the structure 114 or elsewhere.

Alternatives

The description of the different embodiments set forth above has been presented for purposes of illustration and description, and is not intended to be exhaustive or limited to the embodiments in the form disclosed. Many modifications and variations will be apparent to those of ordinary skill in the art.

For example, the illustration of the antenna 100 in FIG. 1 is not meant to imply physical or architectural limitations to the manner in which different embodiments may be implemented. For example, the antenna 100 may be implemented using any number of different components and different dimensions.

Although the different embodiments have been described with respect to aircraft or other vehicles, other embodiments may be applied to other types of applications or structures. For example, the embodiments may be used on mobile platforms, stationary platforms, land, sea, air or space-based structures, and/or other suitable structures.

It is intended that the scope of the invention be limited not by this detailed description, but rather by the claims appended hereto.

What is claimed is:

1. An antenna, comprising:

a plurality of conductors, wherein the conductors are sub-wavelength conductors used for transmitting or receiving radio frequency (RF) signals;

a plurality of antenna taps, wherein each of the antenna taps is connected to one or more of the conductors and the antenna taps connect the conductors to each other;

a plurality of radio frequency (RF) switches, wherein each of the RF switches is connected to one of the antenna taps; and a plurality of combiners, wherein each of the combiners is connected to one or more of the RF switches;

wherein one or more of the RF switches are controlled to dynamically allocate one or more of the antenna taps and conductors connected thereto to a selected one of the combiners, so that the conductors form an antenna element at a desired frequency, by interconnecting the one or more of the antenna taps with the selected one of the combiners, to communicate the RF signals between the conductors connected to the one or more of the antenna taps and the selected one of the combiners.

2. The antenna of claim 1, wherein the RF signals received by the conductors connected to the one or more of the antenna taps are combined into an output signal at a port of the selected one of the combiners.

3. The antenna of claim 1, wherein an input signal at a port of the selected one of the combiners is split for transmission as the RF signals by the conductors connected to the one or more of the antenna taps.

4. The antenna of claim 1, wherein the antenna is a broadband antenna used by more than one function, thereby reducing or eliminating the need for a separate antenna for each function, while allowing the antenna to be integrated into environments with constraints on space.

5. The antenna of claim 1, wherein the conductors are arranged in a linear array.

6. The antenna of claim 1, wherein the antenna taps comprise resistive materials that increase a bandwidth at which the antenna functions.

7. The antenna of claim 1, wherein the antenna taps connect the conductors to each other in a serial arrangement.

8. The antenna of claim 1, wherein every two adjacent conductors are connected to one of the antenna taps.

9. The antenna of claim 1, wherein the antenna taps comprise balanced or unbalanced transmission lines.

10. The antenna of claim 1, wherein the conductors form the antenna element at the desired frequency to maximize power delivered to the antenna taps at the desired frequency.

11. A method of transmitting or receiving radio frequency signals, comprising:

transmitting or receiving one or more radio frequency (RF) signals at an antenna, wherein the antenna comprises:

a plurality of conductors, wherein the conductors are sub-wavelength conductors used for transmitting or receiving the RF signals;

a plurality of antenna taps, wherein each of the antenna taps is connected to one or more of the conductors and the antenna taps connect the conductors to each other;

a plurality of radio frequency (RF) switches, wherein each of the RF switches is connected to one of the antenna taps; and a plurality of combiners, wherein each of the combiners is connected to one or more of the RF switches; and controlling one or more of the RF switches to dynamically allocate one or more of the antenna taps and conductors connected thereto to a selected one of the combiners, so that the conductors form an antenna element at a desired frequency, by interconnecting the one or more of the antenna taps with the selected one of the combiners, to communicate the RF signals between the conductors connected to the one or more of the antenna taps and the selected one of the combiners.

12. The method of claim 11, wherein the RF signals received by the conductors connected to the one or more of the antenna taps are combined into an output signal at a port of the selected one of the combiners.

13. The method of claim 11, wherein an input signal at a port of the selected one of the combiners is split for transmission as the RF signals by the conductors connected to the one or more of the antenna taps.

14. The method of claim 11, wherein the antenna is a broadband antenna used by more than one function, thereby reducing or eliminating the need for a separate antenna for each function, while allowing the antenna to be integrated into environments with constraints on space.

15. The method of claim 11, wherein the conductors are arranged in a linear array.

16. The method of claim 11, wherein the antenna taps act as resistive materials.

17. The method of claim 11, wherein the antenna taps connect the conductors to each other in a serial arrangement.

18. The method of claim 11, wherein every two adjacent conductors are connected to one of the antenna taps.

19. The method of claim 11, wherein the antenna taps comprise balanced or unbalanced transmission lines.

20. The method of claim 11, wherein the conductors form the antenna element at the desired frequency to maximize power delivered to the antenna taps at the desired frequency.

21. A method of fabricating an antenna, comprising:

providing a plurality of conductors, wherein the conductors are sub-wavelength conductors used for transmitting or receiving radio frequency (RF) signals;

connecting a plurality of antenna taps to the conductors, wherein each of the antenna taps is connected to one or more of the conductors and the antenna taps connect the conductors to each other;

connecting a plurality of radio frequency (RF) switches to the antenna taps, wherein each of the RF switches is connected to one of the antenna taps; and connecting a plurality of combiners to the RF switches, wherein each of the combiners is connected to one or more of the RF switches;

such that, when one or more of the RF switches are controlled to dynamically allocate one or more of the antenna taps and conductors connected thereto to a selected one of the combiners, so that the conductors form an antenna element at a desired frequency, by interconnecting the one or more of the antenna taps with the selected one of the combiners, the RF signals are communicated between the conductors connected to the one or more of the antenna taps and the selected one of the combiners.

* * * * *